United States Patent [19]

Paramythioti et al.

[11] 3,964,834

[45] June 22, 1976

[54] APPARATUS FOR COMPACTING OR CONSOLIDATING A FRESHLY SURFACE STRIP

[75] Inventors: Michel Paramythioti, Chantilly; Emmanuel R. De La Sayette, Neuilly; Jacques J. Girard, Gouvieux, all of France

[73] Assignee: Albaret S.A., Rantigny, France

[22] Filed: Jan. 27, 1975

[21] Appl. No.: 544,513

[30] Foreign Application Priority Data

Feb. 1, 1974 France ..... 74.03366

[52] U.S. Cl. ..... 404/84; 404/122

[51] Int. Cl.[2] ..... E01C 19/00

[58] Field of Search ..... 404/84, 112, 122

[56] References Cited

UNITED STATES PATENTS

| | | | |
|---|---|---|---|
| 1,157,899 | 10/1915 | Peterson | 404/112 |
| 2,342,445 | 2/1944 | Allen | 404/112 |
| 2,898,826 | 8/1959 | Livermont | 404/112 |
| 3,221,619 | 12/1965 | Erickson | 404/122 X |
| 3,232,189 | 2/1966 | Young | 404/122 X |
| 3,258,082 | 6/1966 | Amos | 404/84 X |
| 3,774,401 | 11/1973 | Allen | 404/84 X |
| 3,848,690 | 11/1974 | Hawkins | 404/84 X |

*Primary Examiner*—Nile C. Byers
*Attorney, Agent, or Firm*—Diller, Brown, Ramik & Wight

[57] ABSTRACT

Apparatus for effecting passes of a self-propelled compacting machine following a spreading machine after the latter has laid a strip of surfacing composition. A guide vehicle is hitched to the spreading machine and is towed therewith, and has a guide member which may either have the contour of a closed geometrical figure such as a circle or be simply a pivot. The compacting machine turns about the guide vehicle along an epicycloidal path of travel. A sensing device on the compacting machine which may be a feeler or a flexible member is responsive to the variations of the radial distance between the compacting machine and guide member. The sensing device operates a limit switch when the variations exceed a predetermined amount which in turn controls an electrically operable hydraulic valve which communicates with a double-action cylinder and piston unit controlling in turn the direction of the front wheel of the compacting machine for increasing or decreasing the turning radius thereof. The compacting machine is thus entirely automatic and needs no driver when in operation. Such a compacting machine is also provided with a conventional steering wheel and can be used independently of the guide vehicle and the spreading machine.

18 Claims, 7 Drawing Figures

APPARATUS FOR COMPACTING OR CONSOLIDATING A FRESHLY SURFACE STRIP

The present invention relates generally to apparatus for compacting or consolidating a strip of a road surfacing composition freshly laid by a spreading machine.

The spreading of road surfacing compositions is most often performed at the present by a particular spreading machine commonly known as a finisher which is adapted to spread a continuous strip of such a composition having a relatively small thickness over a relatively long distance and, most often, at the rate of 100-200 meters per hour; after the composition is laid by the finisher it must be compacted.

At the present time the compacting of a road surfacing composition is most often carried out by means of compacting machines which are independent of the spreading machine or spreader. Such compacting machines effect alternate back and forth movements behind the spreader with lateral shifting movements at each reversal of direction.

A certain number of drawbacks result therefrom.

Firstly, it is necessary to employ simultaneously several compacting machines, the effective width of such common compacting machines being only a small fraction of the width of the strip laid by the spreader.

Such a situation results in considerable amounts of equipment being tied up and, therefore, elevated production costs.

Further, since these compacting machine are independent in operation, they each require a driver which increases the labor force, thereby further increasing production costs.

In addition, the presence of compacting machines working behind the spreading machine inevitably brings about a marked increase in the total strip length which is worked at any given time; each compacting machine must usually make passes of 30–50 meters for example.

Finally, such compacting machines are very powerful and cause irregularities in the laid surface that they compact each time they shift laterally their direction of forward movement, particularly in the case of vibrating type compacting machines, even when taking the precaution of stopping the vibrator incorporated therein when the compacting machine turns around to avoid overcompacting the surface at this point. This causes discontinuities in compaction in the form of longitudinal waviness on the compacted surface; such waviness is later impossible to eliminate.

To overcome this particular drawback it has been proposed to perform the compacting continuously by means of a compacting machine towed by the spreading machine.

The compacting machines of this type which have been proposed to date obviously make only a single pass and therefore only moderately precompact the surface and necessarily require the subsequent use of independent compacting machines subsequently to complete the job; these independent compacting machines, moreover, have precisely the same drawbacks as mentioned hereinbefore.

A general object of the present invention is to overcome the drawbacks of known compacting machines.

A more specific object of the invention relates to apparatus for compacting or consolidating a surface strip, the apparatus comprising a self-propelled compacting machine having steering means for adjusting the forward direction of the machine, a guide vehicle adapted to be displaced along the strip in association with the compacting machine, the guide vehicle having a guide member for guiding the compacting machine along a path of travel about a vertical axis, sensing means on the compacting machine cooperable with the guide member for indicating variations in the radial distance between the compacting machine and the guide member, automatic control means responsive to the sensing means for controlling the steering means, thereby automatically adjusting the direction of the compacting machine in response to variations in the radial distance.

In practice, the guide vehicle carrying the guide member may be a towed vehicle hitched to a drive vehicle which, preferably, is the spreading machine itself.

The compacting machine according to the invention thus constantly turns about the guide member so that as the guide member undergoes the translatory movement due to the advance of the drive vehicle towing the guide vehicle, the path of travel of the compacting machine effectively describes, with respect to the strip, a cycloidal-like figure covering the entire width of the strip, longitudinally describing a large number of successive passes adapted to ensure a suitable compaction of the surfacing composition.

Thus the compacting of a road surfacing composition may be carried out by a single compacting machine which means a relatively small investment in equipment.

Such an investment is even smaller since the compacting machine is not integrally formed with or inextricably coupled to the guide vehicle with which it is associated but only operatively and releasably connected thereto and therefore may even be used at times for other compacting jobs independently of the spreading machine.

Furthermore, when the compacting machine is operatively associated with the guide vehicle it does not require a driver, thereby reducing the labor force and compacting costs.

Moreover, the presence of the apparatus according to the invention behind the spreading machine results in a relatively short strip length which is worked at any given time, e.g. 10–15 meters.

Additionally, such an apparatus operates continuously, i.e. without stopping to turn around or to shift laterally so that the compacted surface has near perfect surface regularity and is, for example, free from all marked transverse and longitudinal waviness.

When a vibrating type compacting machine is required it is never necessary to stop the vibrator which improves the uniformity of compaction and the service life of the compacting machine.

The objects, features and advantages of the invention will be brought out in the following description, by way of example, with reference to the accompanying schematic drawings, in which.

Figure 1:
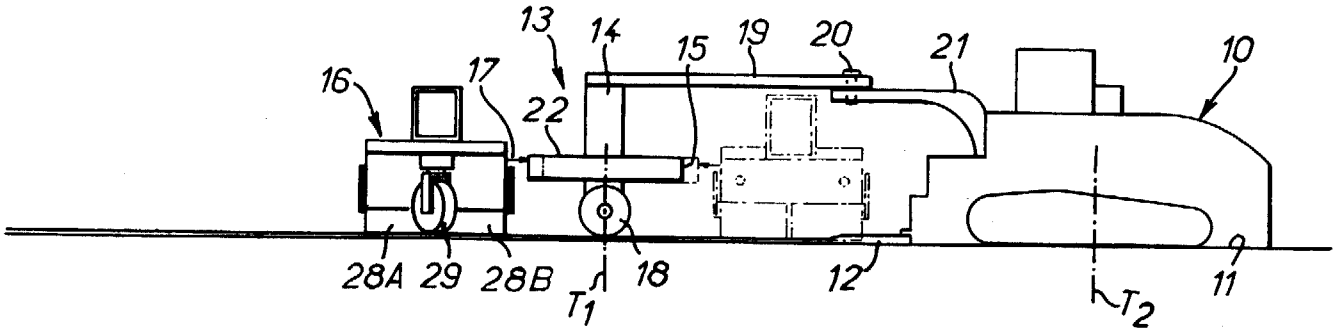
FIG. 1 is a side elevation view of a compacting machine hooked up to a spreader.

The spreader or spreading machine 10, which is known per se, is not in itself part of the present invention and will therefore not be described in detail herein. It is sufficient to say that the spreading machine is adapted to spread on a road bed 11, in the course of construction, a continuous strip 12 of a surfacing compositon, for example asphalt.

The strip 12 of surfacing composition is compacted behind or downstream of the spreading machine 10 with respect to its direction of advance by apparatus 13, including a guide vehicle 14 carrying a guide rail 15 forming a closed figure around the guide vehicle, which in the present case is a circle, and a suitable self-propelled compacting machine 16 with sensing means which, in this embodiment of FIGS. 1-4, is a feeler 17 adapted to cooperate with the guide rail 15, and automatic control means responsive to the sensing means for controlling steering means for the compacting machine; the compacting machine 16 is adapted to also be used independently of the guide vehicle 14.

In practice and in the illustrated embodiment of FIGS. 1-4 the guide vehicle 14 carrying the guide rail 15 is a simple towed vehicle or trailer having a set of wheels 18 and a hitch member 19 enabling it to be coupled to the spreading machine 10. A vertical pivot 20 pivotally connects the hitch member 19 to a bracket member 21 provided on the spreading machine 10.

Preferably, for better guiding the compacting machine 16 along a path determined by the contour of the guide member, the pivot 20 is disposed substantially midway between a transverse plane T1 containing the axis of rotation of the wheels 18 of the guide vehicle 14 and a median transverse plane T2 of the spreading machine 10.

In any event, the hitch member 19 of the guide vehicle 14 and the bracket member 21 on the spreading machine 10 are constructed and arranged so that the spreading machine 10 and the guide vehicle 14 are far enough apart to allow the passage of the compacting machine 16 therebetween, as will now be described.

The guide rail 15 on the guide vehicle 14 may be formed as a cylindrical, preferably metal, hoop of circular cross-section welded, for example, on a platform 22 carried by the guide vehicle 14.

The compacting machine 16 per se is preferably of the vibrating type but does not in itself constitute an essential part of the invention and therefore will not be described in detail. The compacting machine is of a conventional type selected to have a particularly small turning radius which is suited for an automatic direction control system and to mark the surfacing composition being compacted as little as possible, even with sharp turning.

A compacting machine which is particularly suited to the present requirements was described in the first Certificate of Addition No. 70 17795, filed May 15, 1970 and published under No. 2,092,996, to French Pat. No. 1,573,169 filed on Apr. 8, 1968 and entitled "Direction and Speed Control for Motor Vehicle".

Thus such a compacting machine need not be described here in detail. It is simply necessary to specify that it comprises a chassis 25 carried by a forward train of rollers 27, including two drive rollers 28A,28B and a rear train of rollers 29 which in the present example is a single direction control wheel.

Figure 3:
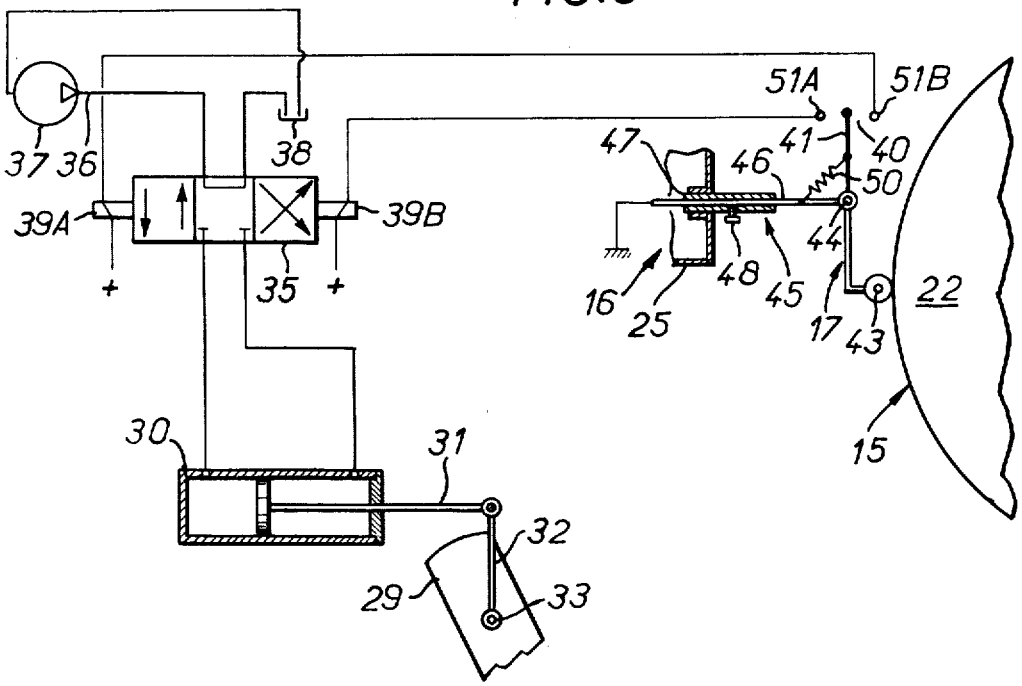
FIG. 3 is a schematic diagram of an automatic direction control system adapted to be used with the compacting machine.

The automatic direction control system, as illustrated in FIG. 3, comprises a double-action hydraulic piston and cylinder unit 30, the piston rod 31 of which is coupled by a steering link 32 to the steering pivot pin 33 of the direction control wheel 29.

In a conventional manner (not illustrated), a hydraulic transmission device is interposed between a conventional steering wheel for manual operation and the double-action piston and cylinder unit 30 supplying power in both directions; such a direction control system advantageously includes an automatic control means. The compacting machine can therefore be steered manually by a driver and used independently of the guide vehicle and spreading machine.

For example, as shown in FIG. 3, the hydraulic unit 30 is controlled by an electrically operable hydraulic valve means 35 with a closed central compartment which is functionally mounted in parallel with the aforementioned hydraulic transmission device, for automatic direction control without a driver.

The operating mode of such valve means is known per se. The valve means will not be described in detail and comprises a slide valve member normally having a central rest position which puts the delivery side 36 of the pump 37 into communication with a discharge tank 38, preventing any communication between the delivery side of the pump and one of the ends of the hydraulic unit 30 as schematically shown in FIG. 3.

By means of electric relays 39A,39B the slide valve member may take either of the limit positions for which the delivery side 36 of the pump 37 is put into communication with one of the ends of the piston and cylinder unit 30 while the other end of the unit is put into communication with the discharge tank 38.

As it will be easily understood, when one of the ends of the hydraulic unit 30 is put into communication with the delivery side 36 of the pump 37, the direction control wheel 29 is pivoted in a first direction, for example, for turning the compacting machine 16 to the right; and when the other end of the hydraulic unit 30 is put into communication with the delivery side 36 of the pump 37, the direction control wheel 29 is pivoted in opposite direction, for example, for turning the compacting machine 16 to the left.

The electric relays 39A,39B of the valve means 35 are arranged in parallel on one of the terminals, e.g. the positive terminal, as shown, of any suitable power source and connected by means of the movable contact 41 of a double limit switch 40 to the other terminal of the power source which in the present example is the ground.

The movable contact 41 of the double limit switch is connected to the sensing means or feeler 17 which is pivotally mounted at 44 by support means 45 on the chassis of the compacting machine 16.

In practice, and as shown, the feeler 17 carries a roller 43 which is in rolling contact with the guide rail 15. The radial distance between the pivot 44 of the feeler 17 and the side of the chassis 25 of the compacting machine 16 is adjustable as desired.

For example as shown, the support means 45 for the feeler is adjustable in length and for this purpose comprises a slidable graduated member 46, which acutally pivotally mounts the feeler 17 at 44, and a sleeve 47 mounted on the frame 25 of the compacting machine 16 and having an adjustment screw 48 for securing the member 46 in the sleeve 47.

A return spring 50 is associated with the feeler 17 for biasing the feeler 17 toward the guide rail 15.

Figure 2:
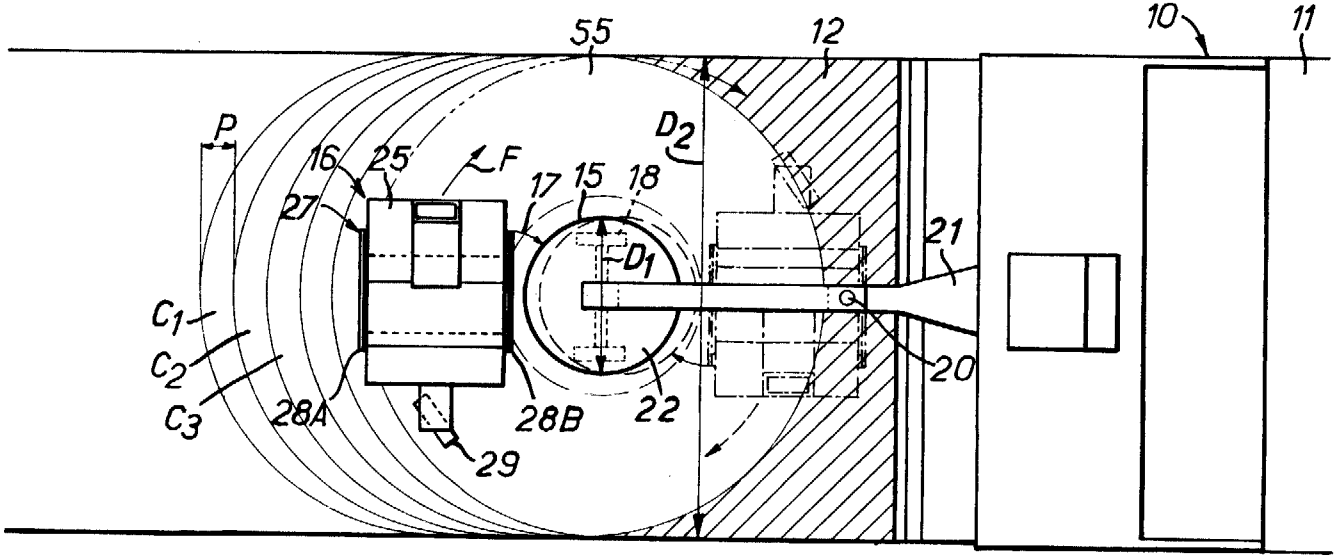
FIG. 2 is a top plan view of the apparatus formed by the spreader and the compacting machine.

The operation of the apparatus of the embodiment of FIGS. 1–4 is as follows:

The guide vehicle 14 carrying the guide rail 15 is hitched to the spreading machine 10, FIGS. 1 and 2.

The compacting machine 16 is then, under the control of a driver, brought next to the guide vehicle 14 until the feeler 17 comes into contact with the guide rail 15.

After putting the automatic direction control means of the compacting machine into operation by bringing the feeler 17 into position and, if necessary, starting the vibrator, the driver can let the compacting machine operate on its own, the speed of forward movement of the compacting machine being relatively low, in the order of 2 to 3 km/h, for example.

From then on the compacting machine turns automatically around the guide vehicle 14 as schematically shown by the arrow F in FIG. 2, precisely following the contour of the guide rail.

If the compacting machine 16 tends to move away from the guide rail 15, the spring 50 associated with the feeler 17 pivots the feeler thereby maintaining the roller 43 in contact with the guide rail 15 and, if the compacting machine 16 moves far enough from the guide rail 15, it actuates the relay 39B of the valve means 35 by bringing the movable contact 41 mounted on the feeler 17 into operative engagement with the contact 51B.

The valve means 35 through the hydraulic unit 30 then brings about a correction of the orientation of the direction control wheel 29 adapted to return the compacting machine 16 to the prescribed radial distance from the guide rail 15 by reducing the turning radius of the compacting machine 16.

Inversely, if the compacting machine 16 starts to come too close to the guide vehicle 14, the guide member pushes away the feeler 17 against the force exerted by the return spring 50 until the feeler 17 eventually brings the movable contact into operative engagement with the other limit contact 51A of the limit switch 40 to supply current to control relay 39A of the valve means 35.

The valve means 35 will then cause the hydraulic unit 30 to effect a correction of the orientation of the direction control wheel 29 so that the compacting machine 16 moves away from the guide vehicle 13 by increasing its turning radius.

It will be noted from FIG. 2 that the compacting machine 16 sweeps an annular zone 55 about the guide vehicle comprising an inner diameter D1 corresponding to the inner edge of the roller 28B closest to the guide vehicle and an outer diameter D2 corresponding to the outer edge of the roller 28A.

The adjustment of the feeler 17 relative to the chassis 25 is done so that the diameter D2 corresponds substantially to the width of the strip 12 of surfacing composition laid by the spreading machine 10 or, as will be brought out hereinafter, slightly greater than this width.

In FIGS. 1 and 2, the spreading machine 10, the guide vehicle 14 and the compacting machine 16 are shown in solid lines at a given momentary position and in dash-dotted lines in a subsequent momentary position, the spreading machine 10 having advanced between these two points in time, directly towing along with it the guide vehicle 14 and indirectly, the compacting machine 16.

Owing to the rotation of the compacting machine 16 about the guide vehicle 14 combined with its forward advance due to the advance of the guide vehicle towed by the spreading machine, the path of movement of the compacting machine 16 in the horizontal plane, describes an epicycloidal figure which sweeps across the entire width of the strip 12 of surfacing composition laid by the spreading machine 10, thereby defining longitudinally a series of partially superposed compacting passes such as schematically illustrated by curves C1, C2, C3 . . . in FIG. 2.

The inter-pass spacing P between consecutive passes along the longitudinal axis of the strip 12 of surfacing composition obviously depends on the relative forward speed of the spreading machine 10 and compacting machine 16.

In practice the longitudinal inter-pass spacing is in the range of 30 to 50 cms.

Figure 4:
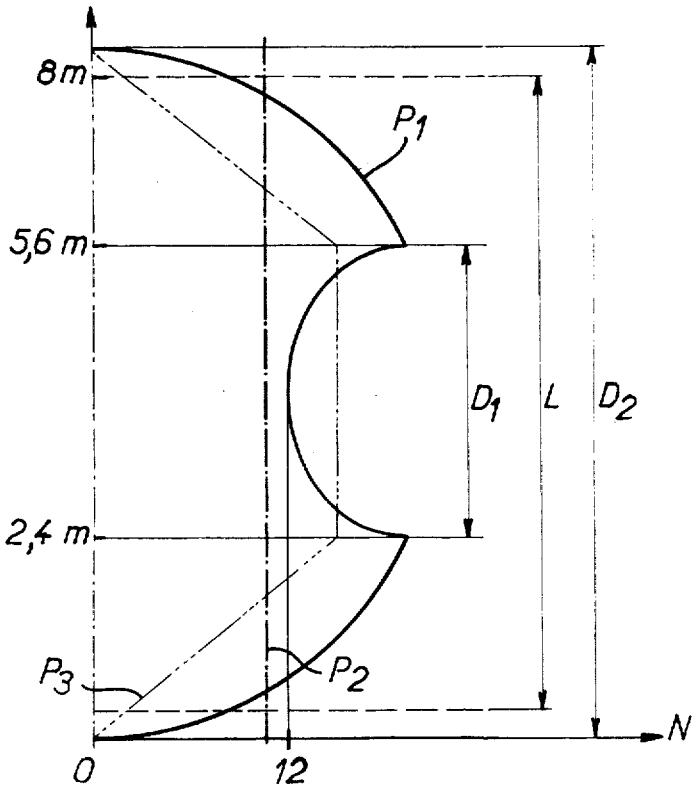
FIG. 4 is a graph illustrating the results obtained with the apparatus according to the invention.

The graph in FIG. 4 gives, by way of example, the number N of compacting passes on the different transverse zones of the strip of surfacing composition 12 laid by the spreading machine for an inter-pass spacing of 40 cm, a strip width of 8 meters, and a compacting machine having a width of 2.4 meters in contact with the ground.

In the graph of FIG. 4 the coordinate of a point on the strip of surfacing composition to be compacted measured from one of the longitudinal edges is marked on the ordinate and the number of passes N is marked on the abscissa.

The number of passes N is obviously zero along the edges of the strip having a width L when the diameter D2 of the annular zone swept by the compacting machine 16 also has a dimension L.

This is why, as previously mentioned, it is advantageous to choose the diameter D2 slightly greater than the width L of the strip 12 to be compacted. For this result it is simply necessary to extend the feeler 17 slightly farther from the chassis 25 of the compacting machine 16 by means of its telescopic mounting on the chassis, as described hereinabove.

The number N of compacting passes will obviously increase from each edge of the strip 12 toward the central zone of the strip, but thereafter it decreases in the central zone of the strip corresponding to the inner diameter D1 of the annular zone 55 swept by the compacting machine 16. In fact, the number of passes along the center line of the strip 12 is double the width of the compacting machine 16 divided by the inter-pass spacing P.

The representative curve P1 of the number of compacting passes achieved with the compacting machine described herein is shown in solid lines in the graph of FIG. 4.

If one takes the care to see to it that the outer diameter D2 of the annular zone 55 swept by the compacting machine 16 is slightly greater than the width L of the strip, the curve P1 is substantially beyond the ideal line P2 which corresponds to an equal number of compacting passes for all points on the strip along a given transverse line; the ideal line P2 is shown in the graph of FIG. 4 in dash-dotted lines.

For this reason the effectiveness of the compaction obtained by the above-described apparatus is superior to the compaction obtained under the same conditions with one or more compacting machines having a comparable compacting capacity and going back and forth along lines parallel to the center line of the strip with lateral shifts each time the direction of the compacting machine is reversed.

The representative curve P3 of the number of compacting passes obtained in this case has inclined straight lines extending from the longitudinal edges of the compacted strip as indicated in phantom lines in the graph of FIG. 4 so that, in a large zone of the strip adjacent each of the edges, the number of passes N is substantially less than the desired number of passes N.

Figure 7:
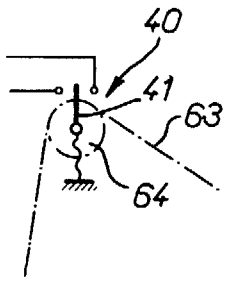
FIG. 7 is a schematic view of a sensing device particularly adapted for the alternative embodiment.
Figure 5:
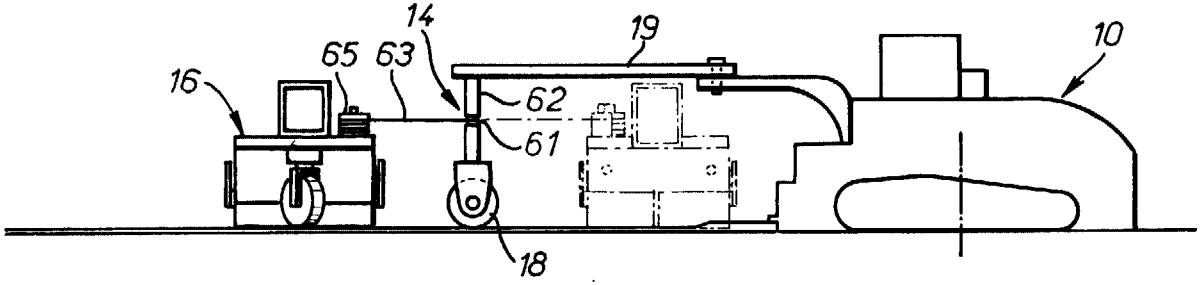
FIGS. 5 and 6 are side elevation and top plan views, respectively similar to FIGS. 1 and 2 of an alternative embodiment.
Figure 6:
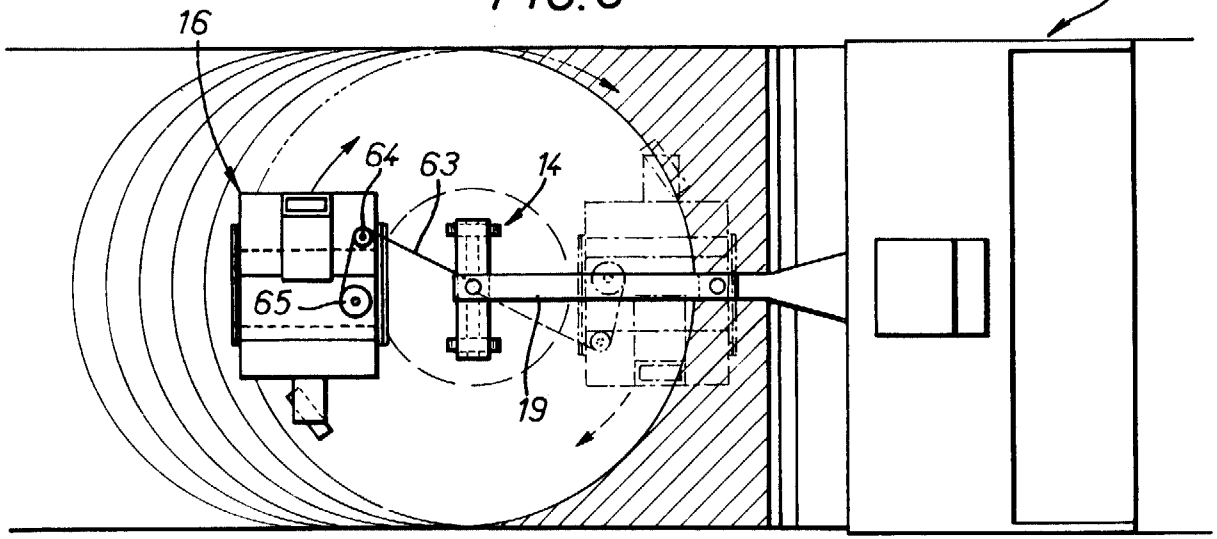

In the alternative embodiment of FIGS. 5–7, the towed guide vehicle 14 is a simple trailer hitched to the spreading machine 10 by a hitch member 19; the guide member carried by the guide vehicle, in this case is a mere pivot extending vertically on the trailer. For example, a collar 61 may be rotatably mounted on a vertical spindle 62 between shoulders formed thereon, the vertical spindle 62 extending between the hitch member 19 and the associated set of wheels 18.

The sensing means carried by the compacting machine 16 includes a flexible member or cord 63 coupled to the ring 61.

In the illustrated example the sensing means also includes an annular rotary member 64 which could alternatively be a slide valve, displaceable axially (not shown).

In the illustrated embodiment, the movable contact 41 of a double limit switch 40 (FIG. 7) is fixed to the axis of the annular rotary member 64 and the flexible member 63 is in contact with at least part of the periphery of the annular member. In practice the flexible member 63 may be wound several times around the annular member 64, as shown in FIG. 5, in order to ensure a good friction drive.

The other end of the flexible member is secured to tensioning means. In the illustrated embodiment the tensioning means is a rotatably mounted drum 65 on which a reserve of the flexible member 63 is wound; the reserve of the flexible member wound on the rotatable drum 65 is held under tension by means of a torsion spring (not shown).

The operation of the embodiment of FIGS. 5–7 is similar to that of the preceding embodiment. The compacting machine maintains the flexible member 63 under tension while turning round the collar 61 carried on the guide vehicle 14. If the turning radius gets smaller the effective radial length of the flexible member becomes smaller as it is further wound around the drum 65, being drawn by the biasing spring, thereby turning the annular member 64 in a direction corresponding to the direction of the direction control wheel of the compacting machine which will increase the turning radius thereof. Inversely, if the turning radius tends to increase, the flexible member will turn the annular member in the opposite direction which, in turn, decreases the turning radius of the compacting machine.

The flexible member is preferably releasably connected to the collar 61, for example, by a snap hook.

In a non-illustrated embodiment the drum 65 comprises two disengageable coaxial parts, one of the parts carrying the flexible member 63 and the other part biased by resilient means which allows, when disengaging the two parts, the winding of the flexible member 63 held in reserve to adjust the effective free length of the flexible member and thereby the turning radius of the compacting machine 16 about the collar 61.

The present invention is of course not limited to the illustrated and described embodiments but encompasses all variations within the spirit and scope of the apended claims.

In particular, the direction control system of the compacting machine may include an electric motor with two directions of rotation instead of the "on" and "off" operation of the system in the preceding illustrated embodiments; but in a similar manner a potentiometer is coupled to the sensing means and operatively connected to the power supply for the motor. Such a control system is well known to the man in the art and need not be described in detail.

What we claim is:

1. Apparatus for compacting or consolidating a surfaced strip, said apparatus comprising a self-propelled compacting machine having steering means for controlling the direction of movement of said machine, a guide vehicle displaceable along a strip in association with said compacting machine, means operatively associating said compacting machine with said guide vehicle for displacement along a strip with said guide vehicle; and means including a guide member on said guide vehicle for guiding said compacting machine along a path of travel about a vertical axis defined by a portion of said guide vehicle, and sensing means on said compacting machine cooperating with said guide member for indicating variations in the radial distance between said compacting machine and said guide member; automatic control means connected to said steering means and said sensing means and responsive to said sensing means for controlling the position of said steering means, thereby automatically adjusting the direction of movement of said compacting machine in response to variations in said radial distance.

2. Apparatus according to claim 1, together with a tractive vehicle, and coupling means between said tractive vehicle and said guide vehicle for towing said guide vehicle by said tractive vehicle.

3. Apparatus according to claim 2, wherein said tractive vehicle is a spreading machine for spreading a surfacing composition, and further comprising hitching means coupling the guide vehicle to said tractive vehicle.

4. Apparatus according to claim 3, wherein said hitching means includes a hitch member on the vehicle and a bracket member on the tractive vehicle, said last-mentioned members being coupled together.

5. Apparatus according to claim 4, wherein the guide member is a closed geometric figure.

6. Apparatus according to claim 5, wherein the guide member is circular.

7. Apparatus according to claim 1, wherein the sensing means is a feeler engaging said guide member, and wherein support means are provided for adjustably mounting the feeler on the compacting machine for varying the nominal radial distance between the compacting machine and the guide member in order to compensate for different strip widths.

8. Apparatus according to claim 1, wherein said automatic control means includes a double action hydraulic cylinder and piston unit connected to said steering means, a limit switch connected to said sensing means adapted to be actuated in response to predetermined excesses in the radial distance between the compacting machine and the guide member, said limit switch being connected to an electrically operable valve means for hydraulically controlling the displacement of the piston in the cylinder.

9. Apparatus according to claim 1, wherein said automatic control means for said steering means comprises an electric motor with two directions of rotation, and a potentiometer connected to said sensing means for regulating the speed and direction of rotation of said electric motor.

10. Apparatus according to claim 1, wherein said guide member is a pivot generally coinciding with the vertical axis on said guide vehicle, and wherein said sensing means includes a flexible member coupled to said pivot, and wherein the effective length of the flexible member corresponding the radial distance between the compacting machine and the guide member is variable.

11. Apparatus according to claim 10, wherein said automatic direction control means includes a limit switch with a movable contact mounted for rotation and responsive to changes in the effective length of the flexible member.

12. Apparatus according to claim 11, wherein said movable contact is mounted for rotation on an annular rotatable member, and wherein the flexible member is wound around at least part of the periphery of the annular member.

13. Apparatus according to claim 12, wherein the sensing means further includes tensioning means coupled to the flexible member remote from the guide member for tensioning the flexible member.

14. Apparatus according to claim 13, wherein said tensioning means comprises a drum mounted for rotation, some of the flexible member being wound about the drum and providing a reserve and resilient means for biasing the drum to tension the flexible member.

15. Apparatus according to claim 13, wherein the drum is formed in two coaxial disconnectable parts, the flexible member being wound around one of the coaxial parts and said resilient means for tensioning the flexible member being connected to the other coaxial part.

16. Apparatus according to claim 10, wherein the end of the flexible member adjacent the guide member is secured to a collar, said collar being rotatably mounted on the pivot.

17. Apparatus according to claim 1, wherein the path of travel of the compacting machine as it turns about said guide member and progresses along a strip with said guide vehicle is epicycloidal.

18. Apparatus according to claim 1, wherein the steering means is of the type for changing the turning radius of said compacting machine in response to changes in the position of said steering means in accordance with variations in said radial distance.

* * * * *